US006641453B1

(12) United States Patent
Morales et al.

(10) Patent No.: US 6,641,453 B1
(45) Date of Patent: Nov. 4, 2003

(54) CONSTRUCTION SET FOR BUILDING STRUCTURES

(75) Inventors: Raymond Morales, Bronx, NY (US); Richard Sheron Sherin, Lutz, FL (US); Princess Izevbua Uerenikhosen Imoukhuede, Matteson, IL (US); Damien Burke, Oceanside, CA (US); Maribel Gomez, Dallas, TX (US); Desiree Lin Ramirez, Carmichael, CA (US); Antonio Castaneda, Detroit, MI (US)

(73) Assignee: Academy of Applied Science, Concord, NH (US)

( * ) Notice: Subject to any disclaimer, the term of this patent is extended or adjusted under 35 U.S.C. 154(b) by 0 days.

(21) Appl. No.: 09/494,216

(22) Filed: Jan. 28, 2000

(51) Int. Cl.[7] ..... A63H 33/08

(52) U.S. Cl. ..... 446/126; 446/124; 434/211; 273/157 R

(58) Field of Search ..... 446/106, 85, 107, 446/119, 120, 121, 124, 125, 126; 434/211–214; 273/156, 157 R

(56) References Cited

U.S. PATENT DOCUMENTS

| | | | | | |
|---|---|---|---|---|---|
| 3,600,825 | A | * | 8/1971 | Pearce | 434/403 |
| 4,787,191 | A | * | 11/1988 | Shima | 52/655.2 |
| 5,049,105 | A | * | 9/1991 | Glickman | 446/126 |
| 5,318,470 | A | * | 6/1994 | Denny | 446/126 |
| 5,785,529 | A | * | 7/1998 | Hearn et al. | 434/211 |

* cited by examiner

*Primary Examiner*—Derris H. Banks
*Assistant Examiner*—Bena B. Miller
(74) *Attorney, Agent, or Firm*—Rines and Rines

(57) ABSTRACT

A novel construction set particularly useful for children safely to assemble and use two-and three-dimensional structures of a wide range of sizes and shapes with flexible foam-like tubes or rods detachable to male or female elements carried by foam-like connectors, and preferably of hexaoctahedral or spherical contour, and with such novel geometric design also useful with other construction materials for other uses as well.

15 Claims, 10 Drawing Sheets

CONSTRUCTION SET FOR BUILDING STRUCTURES

The present invention relates to construction sets for children and for commercial and other uses as well, enabling the building of both two and three-dimensional structures of various dimensions and geometry, preferably using elements made of foam, plastic and the like to provide flexible and safe structures.

BACKGROUND

There have long been marketed a great many toy construction sets composed of pieces or elements which interconnect to build and or construct various frameworks. Many kinds of such sets are not safe for younger children and some are even difficult to use without adult supervision and/or aid. The construction sets on the market to date, moreover, are limited in the size or shapes of the constructions that can be made using the set. Some such construction sets have been made out of very dense and hard materials, which are not safe for users of all ages; and some that are safe, have relatively recently been formed of resiliently bendable foam plastic tubes or rods as of closed cell polyethylene or the like, connectable by square or rectangular foam connector blocks having tube or rod-receiving apertures or holes in opposite sides—but still with limitations on construction size, shapes and usage.

The prior art includes patent: U.S. Pat. No. 5,910,038 which has constructional toy pieces that are actually puzzle pieces. This toy set is more closely related to a three dimensional puzzle. These puzzle pieces connect by ridges that run along the edges of each puzzle piece. U.S. Pat. No. 5,873,206 utilizes a fixed number of metal and/or plastic five sided and six sided building blocks. U.S. Pat. No. 5,762,530 uses ridges and grooves to provide parts that can pivot. U.S. Pat. No. 5,732,518 also uses building blocks as a means of constructing figures. U.S. Pat. No. 5,661,942 uses tubular PVC pipes as the framework for all structures. These PVC pipes interlock using connector pegs. U.S. Pat. No. 5,281,185 uses foldable building blocks that fold along long series of fold lines. The blocks have uniformly spaced slots where they connect. U.S. Pat. No. 5,800,239 is a small toy set that uses cubes with semicircular holes that connect to each other by the use of rods with ends that match up.

The present invention is primarily concerned with such safe sets using such foam-like materials, but with removing such prior limitations on sizes and shapes and adapting the sets to create not just two-dimensional structures but three-dimensional structures as well—and with the resulting structures of greatly expanded functional usage such as, for example, as tent structures, play houses, and other functionally usable frameworks.

The present invention achieves these objectives through forming preferably foam-like connectors into geometric shapes that provide not just opposite rectangular box surface connection openings, but a plurality of closely spaced connection openings or regions spherically distributed all over the connector surface contour to receive multi-angular radially extending tubes or cylindrical or other rods inserted to extend divergingly therefrom at many different angles. With such novel foam connectors, moreover, vastly increased sizes and shapes of the frameworks can be constructed and in three-dimensional frameworks that children may climb upon with safety. The foam provides its own high joint friction that sets in once the rod or tube elements are interlocked in the connector opening or attachments, while still sliding in and out of the joints easily and hassle-free. This foam construction also allows the elements to be made on larger scales without decreasing the flexibility or durability of the elements. In addition, the foam is flexible enough to allow imperfect connection angles to be readily accommodated, and users can construct temporary or permanent structures which can be placed indoors or outdoors and in which children may play, such as, but not limited to, the before-mentioned play houses, tents, forts and doll houses and the like.

OBJECTS OF THE INVENTION

An object of this invention, accordingly, is to provide a new and improved construction set using novel geometry foam connector designs for flexible tubes and rods and that overcomes the limitations of prior art sets, above-described, and that is easy and safe to assemble and allows use by users of all ages, and without the requirement of adult assistance, and, further, that expands the construction even to relatively large-sized frameworks and to other functional uses as well.

Another object is to provide a novel flexible foam-like structure reconnectable to tube or rod structures and of expandable size and shape and of more general utility, as well, and particularly useful sets of such flexible and resilient foam like materials for assembly.

A still further object of the present invention is to provide a construction set that is also an educational tool, illustrating the basic principles of geometry, basic physics and mathematics at work.

Other and further objects will be discussed hereinafter and are particularly delineated in connection with the appended claims.

SUMMARY

In summary, the invention embraces a flexible-construction set comprising a plurality of tubes or rods inter-connectable by connector nodes and wherein the connector nodes are made of foam-like material and formed in a three-dimensional geometric shape such as to provide a surface contour of successive adjacent surface portions each containing an attachment element therein to provide a plurality of adjacent connection attachment elements spherically distributed over the connector node surface contour for receiving the tubes or rods to be attached thereto and to extend radially therefrom at predetermined desired angles of a corresponding plurality of angles radially diverging from the connector node.

The present invention in one important application is concerned with the building of various lightweight flexible architectural frameworks that can be safely made by users of all ages, using the parts and accessories of the set, including multi-sided geometric connectors with adjacent holes or connection regions on every face or spherical surface portion, and with the holes or connections at many orientations. Cloths or other drapes, may adorn the structures, held by clamps that fit snugly onto the rods to hold the cloth or covering in place, as hereinafter more fully described.

The rods, connectors and clamps are all best made of foam-like materials for these applications, being provided in a variety of themes and designs and colors. By combining the unique themes and colors in the sets or kits, the designer can continue to develop three-dimensional structures with limitless variations of frameworks, providing users of all ages and capabilities with the opportunity to enjoy this safe, durable and educational flexible-constructional set.

The foam construction set or kit of the invention may contain various parts with different colors, designs, and densities, and can be readily constructed as three-dimensional structures for use as a construction toy or as a decorative display or as a functional structure. With this kit, one may utilize the male-female interlocking connector system of the pieces to construct varied two and/or three dimensional structures in a plethora of forms, including, but not limited to, frameworks such as the before-mentioned tents, or play or doll houses, or igloos and forts, as a few illustrations. The elements of the kit may be solid or hollow with varied dimensions and geometry. Also included in the construction kit may be the before-mentioned cloths or coverings made of various materials and sizes that can be used to enhance the functional uses and appearance of the structures if so desired.

Preferred and best mode designs and structural configurations are hereinafter discussed in detail.

BRIEF DESCRIPTION OF THE DRAWINGS

The present invention can best be understood in conjunction with the accompanying drawings, in which.

Figure 2:
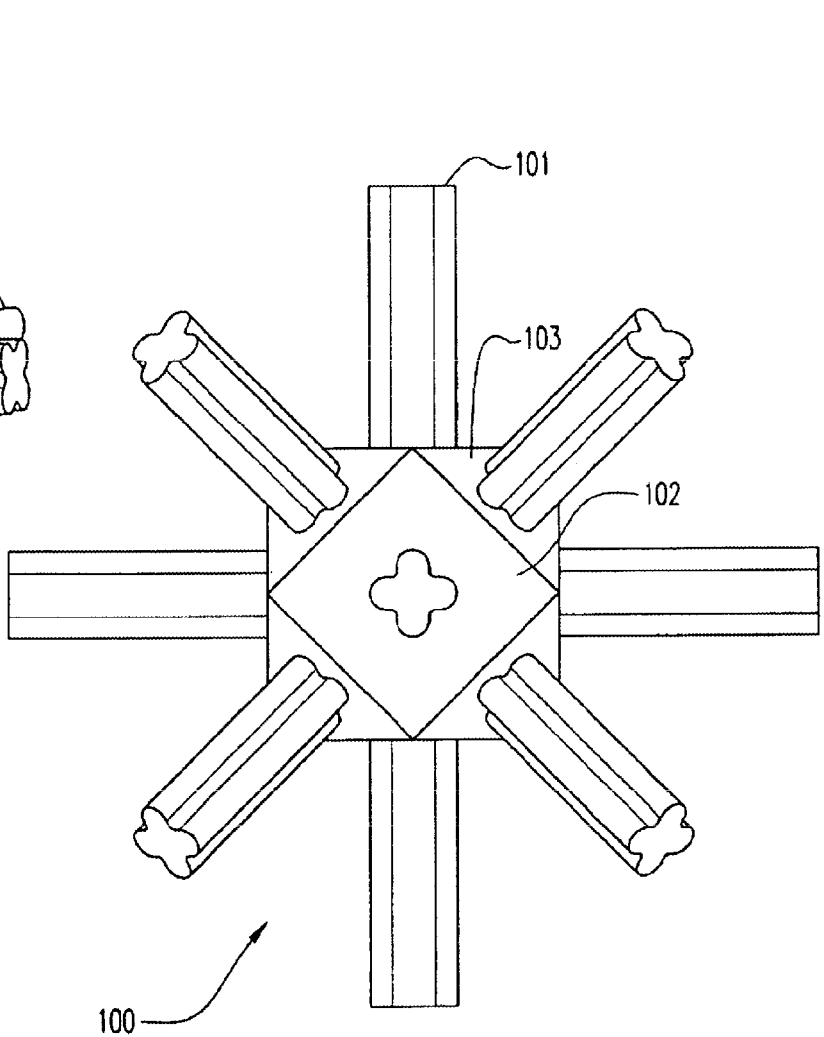
FIG. 2 shows a side view of the structure of FIG. 1.

In the drawings, preferred embodiments of the invention are illustrated by way of example. It is to be expressly understood that the description and drawings are only for the purpose of illustration, and are not intended as a definition of or restriction on the limits of the invention.

DETAILED DESCRIPTION OF PREFERRED EMBODIMENTS

The flexible-construction sets or kits of assemblable elements designed in accordance with the present invention include preferably flexible resilient foam-like structural beams, shown as tube or rod beams, (as, for example, of the before-mentioned closed-cell polyethylene foam material or the like) and appropriate geometric surface foam-like material connector core elements having prongs or openings for receiving the tubes or rods and serving as connector points or nodes in an assembled structure or framework.

Figure 9:
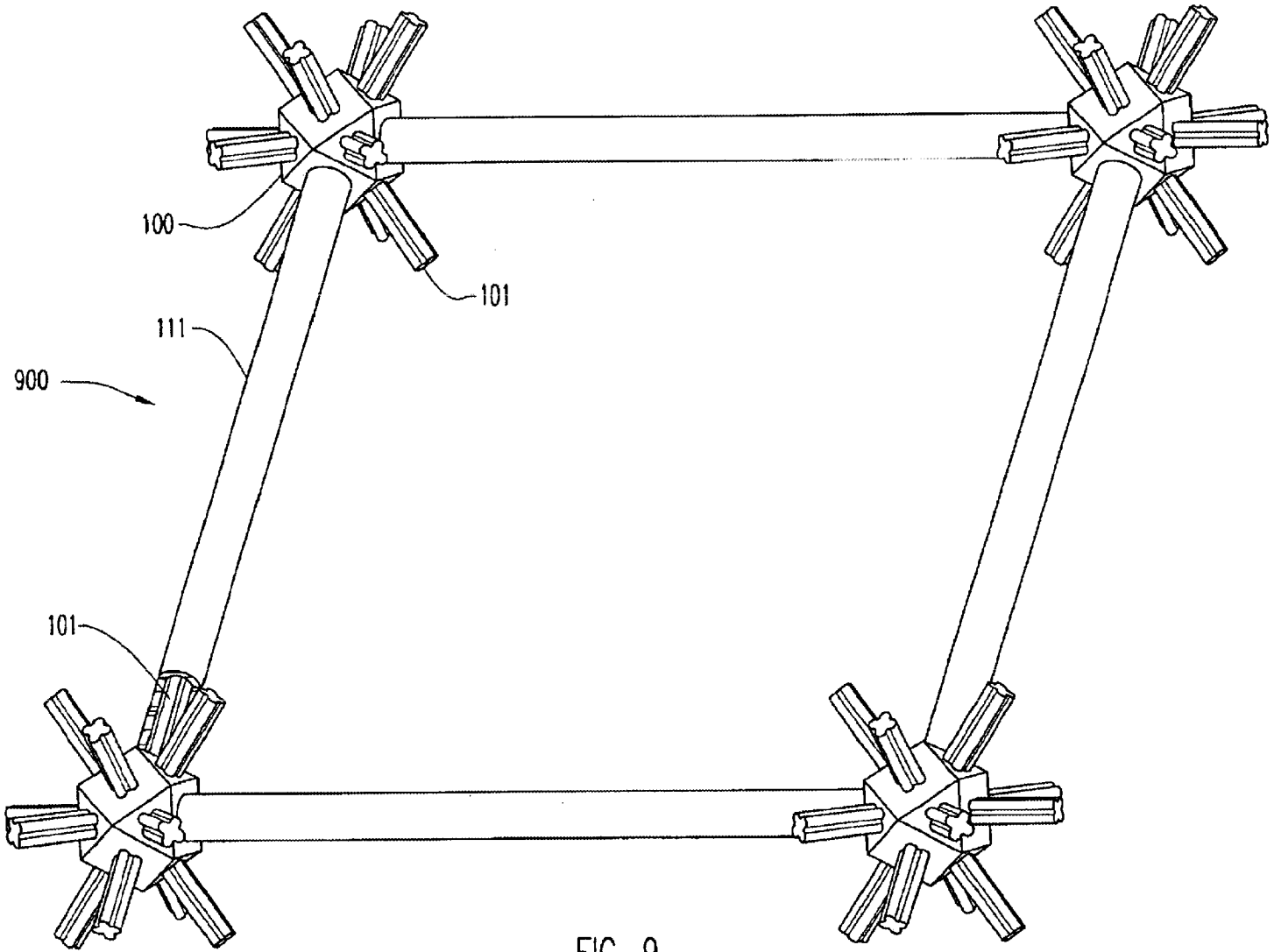
FIG. 9 shows the base plane of an assembled cube structure made using pronged hexaoctahedral core connectors.

In FIG. 9, for example, such a structure is shown at 900 assembled as a 2-dimensional planar rectangular frame having four corner node connector core elements 100 of the before-mentioned "hexaoctahedral" geometry type, shown in larger scale in FIGS. 1 and 2, and later more fully described, and formed by connecting hollow flexible resilient tubes 111, fitted over male attachment prong elements 101 extending from core connector surface facet portions. A three-dimensional structure assembly of similar components is illustrated at 700 in FIG. 10, forming a cubical framework by adding four more corner node connector core elements 100 and eight additional tubes 900 A, 900 B, etc., connected over connector prongs extending at right angles to the prongs 101 of the connectors 100 of FIG. 9.

Figure 10:
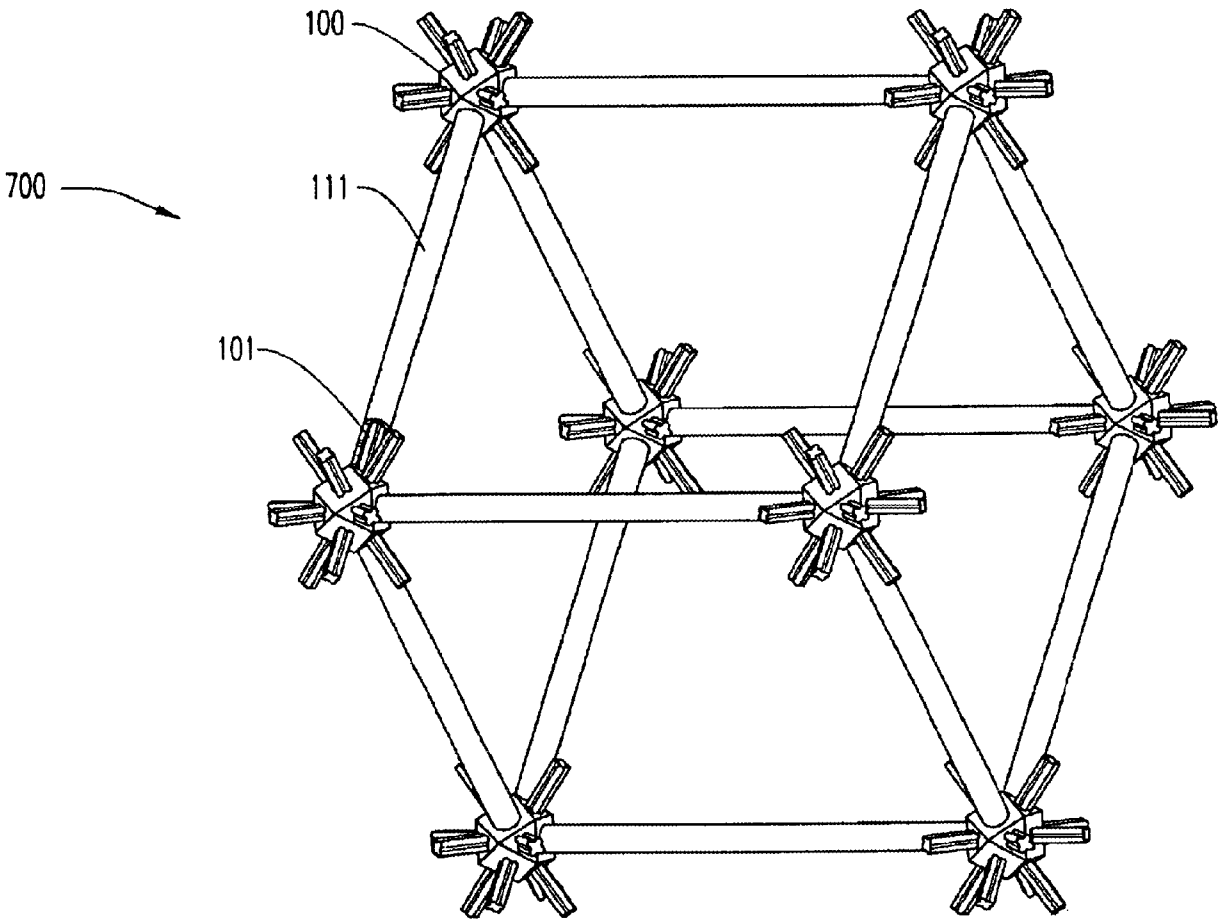
FIG. 10 shows a cube structure made using the pronged hexaoctahedral core of FIG. 1.

The "hexaoctahedral" node connectors 100 of FIGS. 1and 2, used in the structures of FIGS. 9 and 10, have adjacent alternate triangular (103) and rectangular (102) surfaced contour facet portions, each having a preferably centrally provided tube-connecting region at which each surface portion is shown carrying a radially protruding male attachment prong element 101 over which an end of the tube will fit to make an assembly attaching connection. The tube-attaching male prong elements 101 are shown preferably exteriorly symmetrically spherically distributed over the connector node surface contour for receiving tubes thereover at multi-angles as desired. The plurality of prong, elements extend radially from the fixed center of the connector node at a corresponding plurality of radially diverging angles (in this case, ±45° to one another). This provides a wide variety of attaching possibilities and angles at each node connector, as desired, (fourteen in this embodiment), and permits all kinds of shapes and sizes of structural assemblies.

Figure 6:
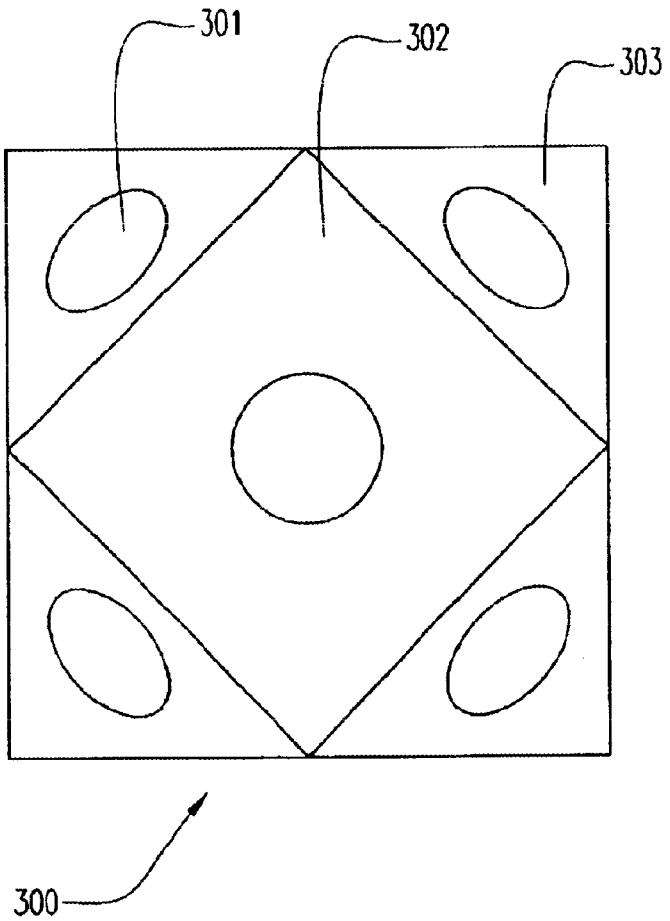
FIG. 6 shows a side view of FIG. 5.
Figure 5:
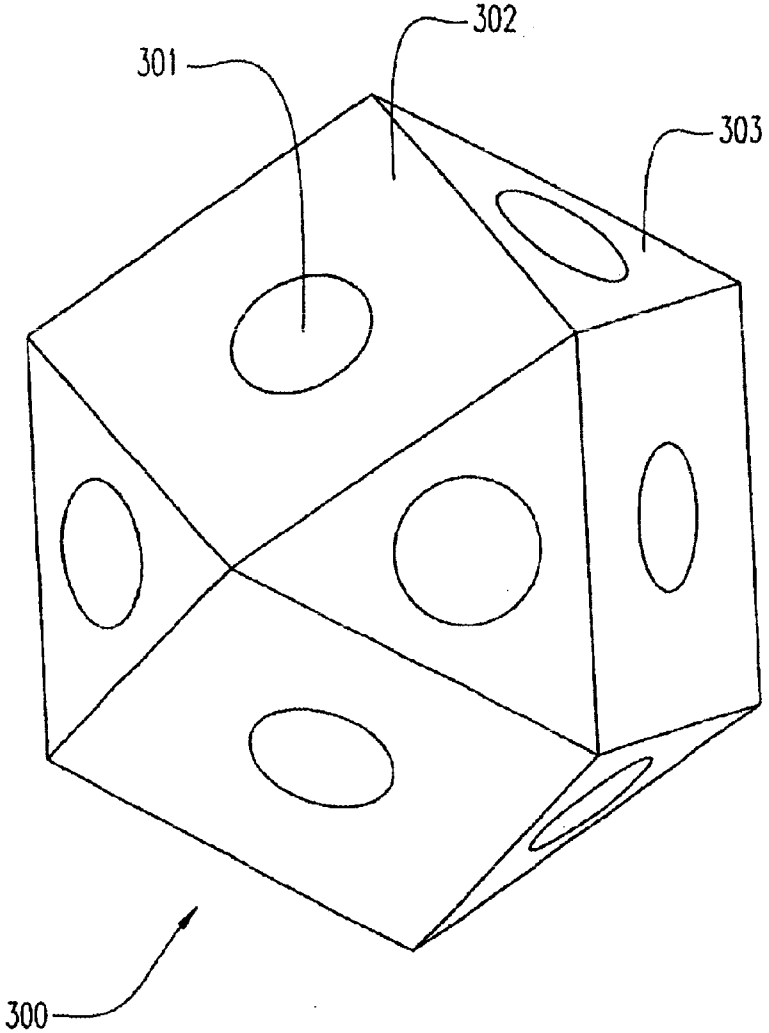
FIG. 5 shows the "hexaoctahedral" connector core of FIGS. 1 and 2 adapted to receive rods or tubes therein.

If rods are to be used (or tubes, also), the attaching regions on the surface contour facet portions of the node connector 100 may just be female attachment aperture or opening elements disposed in the same regions where the prong elements 101 are now shown; as, for example, at 301 in respective square and triangular surface portions 302 and 303 in the hollow connectors 300 of FIGS. 5 and 6. Mortices 301 may be used at the openings, preferably of slightly varied radius from that of the rod (or tube) for optimal construction capability and stabilizing.

Figure 1:
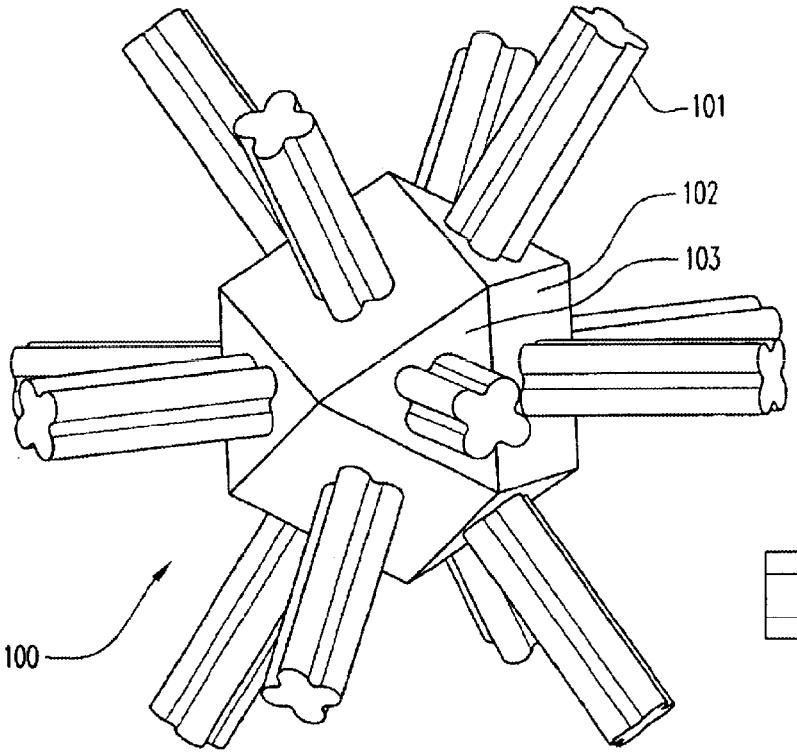
FIG. 1 shows an isometric view of an exemplary or illustrative, though preferred, 14-pronged foam connector core or surface shape or contour, formed from a cube (six side or "hex")—surfaces cut along, say, 45° at each of its eight corners ("octa") to provide 14 adjacent multi-angles adjacent triangular and square surface contour facet portions, and accordingly herein termed a "hexaoctahedral" geometric structure.
Figure 3:
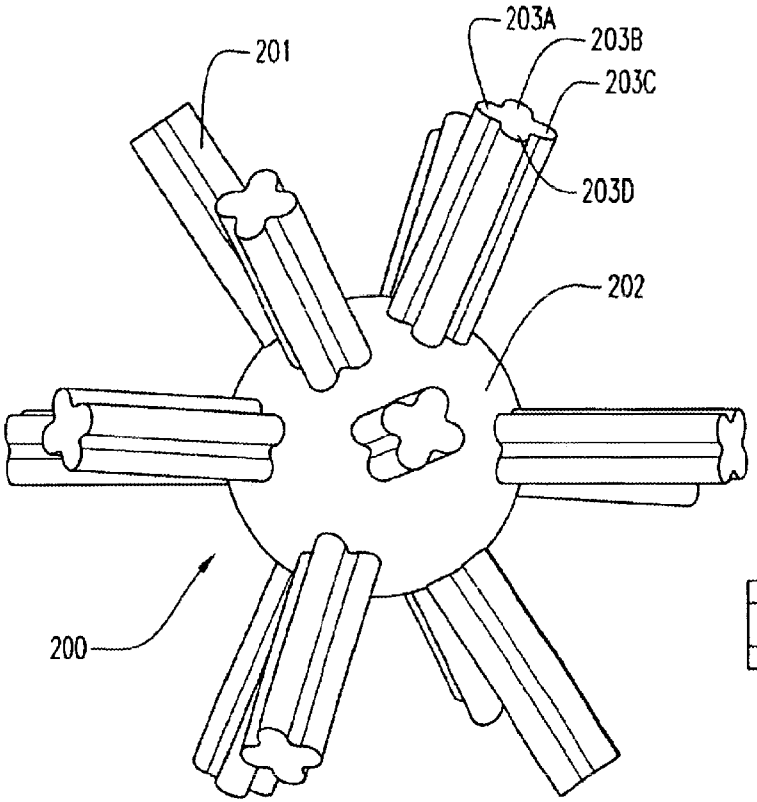
FIG. 3 shows an isometric view of a similar, also preferred, 14-pronged spherical connector configuration.
Figure 8:
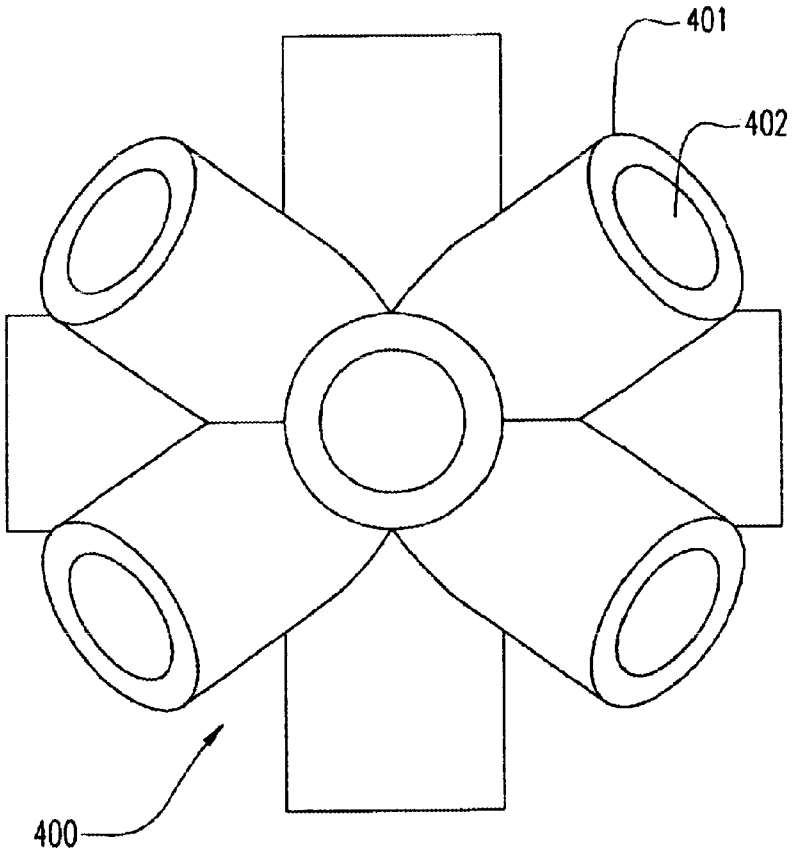
FIG. 8 shows a side view of FIG. 7.
Figure 7:
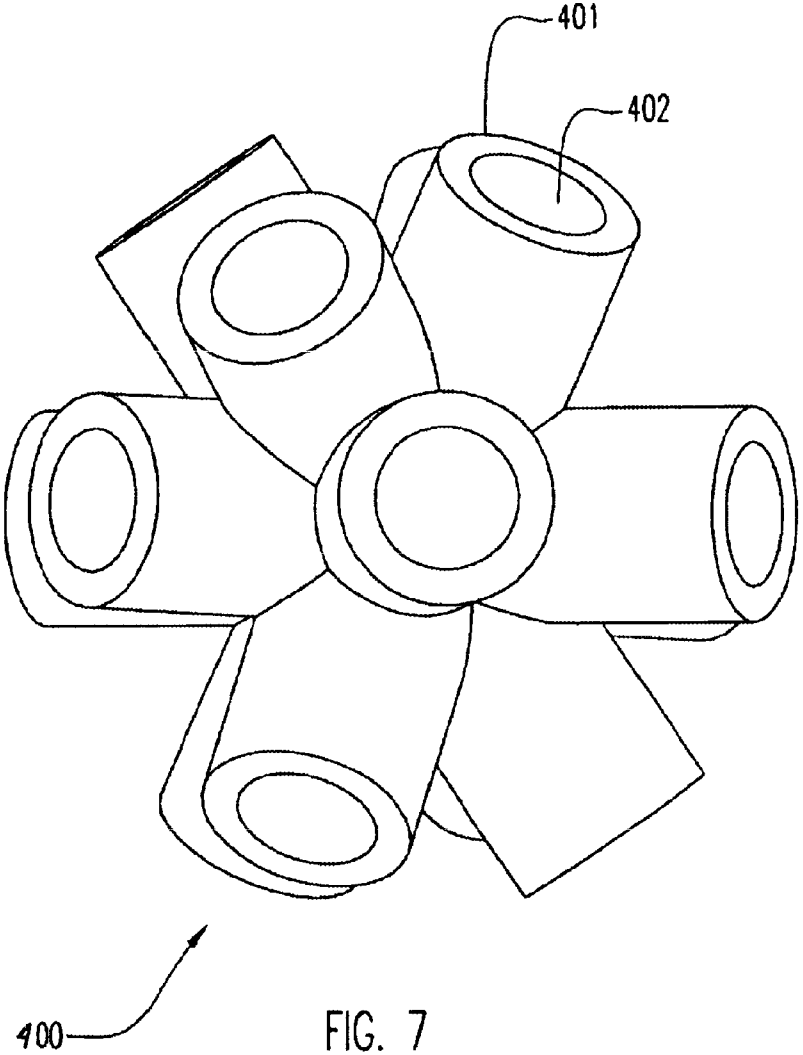
FIG. 7 shows an isometric view of a modification comprising a 14-receptor site hollow arm connector.

In some applications, the plurality of multi-angular mortises in the openings of FIGS. 5 and 6 may be formed as a self-supporting cluster 400 of integral-hollow arm connector receptors 401, FIGS. 7 and 8, and radially extending from a fixed center along multi-radially diverging angles from the center over an outer spherical contour; in this case, a 14-receptor site multiple hollow arm connector structure is provided corresponding to the hexaoctahedral male prong array of FIGS. 1 and 3 and the mortised female attachment openings of FIG. 5. Again mortises 402 may be of slightly varied radius from that of the interconnecting rods or tubes for optimal construction capability and stability.

Figure 4:
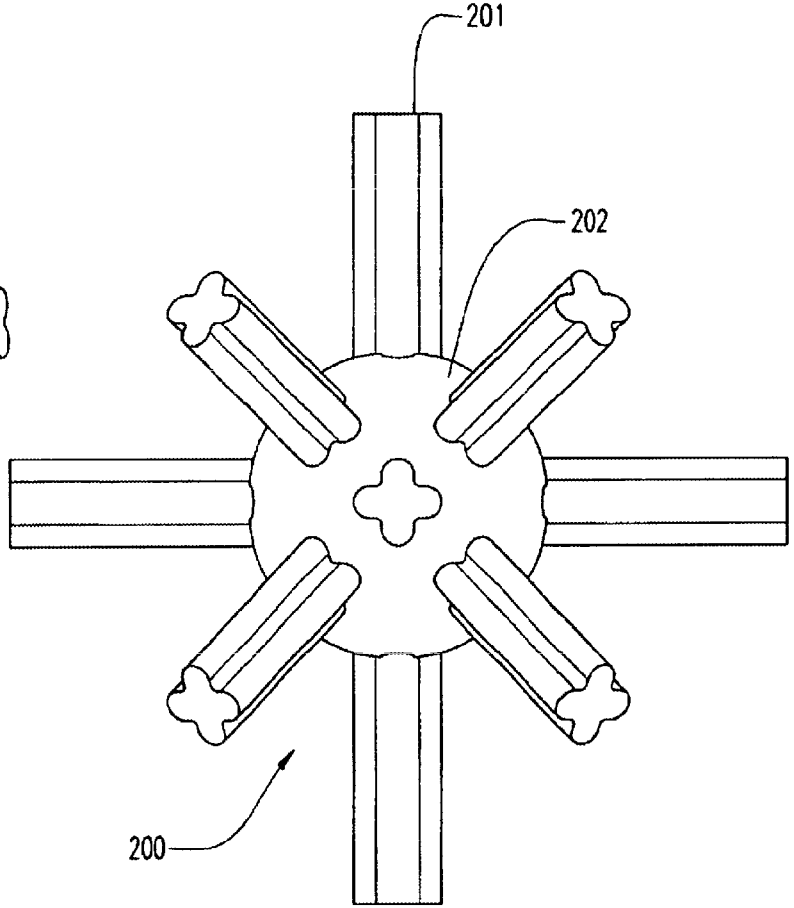
FIG. 4 shows a side view of the modification of FIG. 3.

As before indicated, another preferred geometric shape for the node connector is a spherical or substantially spherical contour instead of polyhedral, contour. Adjacent surface portions 202 of the spherical contour of the connector node 200, FIGS. 3 and 4, are provided with the same distribution of 14 adjacent radially extending diverging male attachment elements 201. Fluting or scalloping 203 A, B, C and D, (a cross in cross-section) is shown provided in the attachment prong elements.

Figure 11:
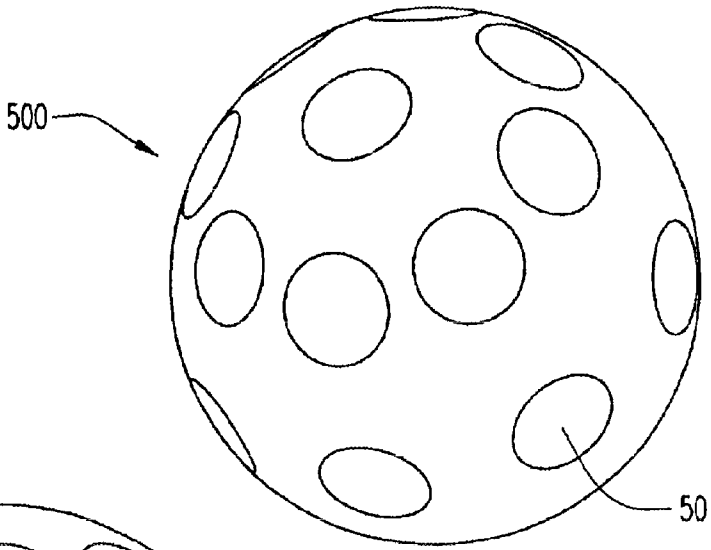
FIG. 11 shows a spherical connection in a generic orientation.
Figure 12:
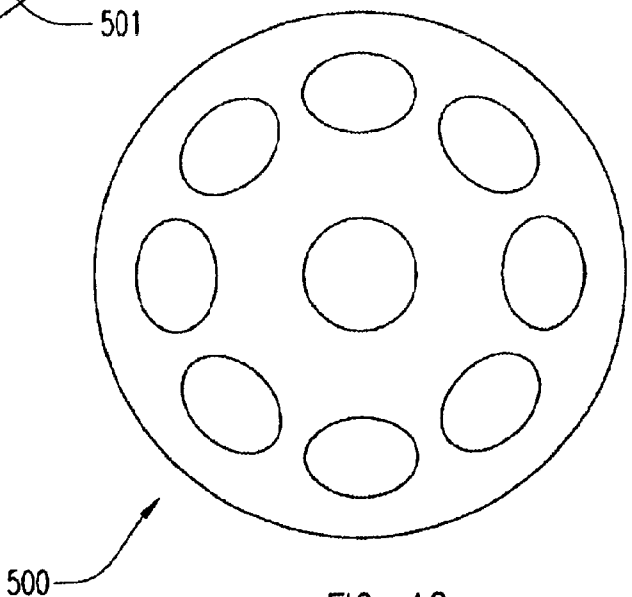
FIG. 12 shows a top view of FIG. 11.
Figure 13:
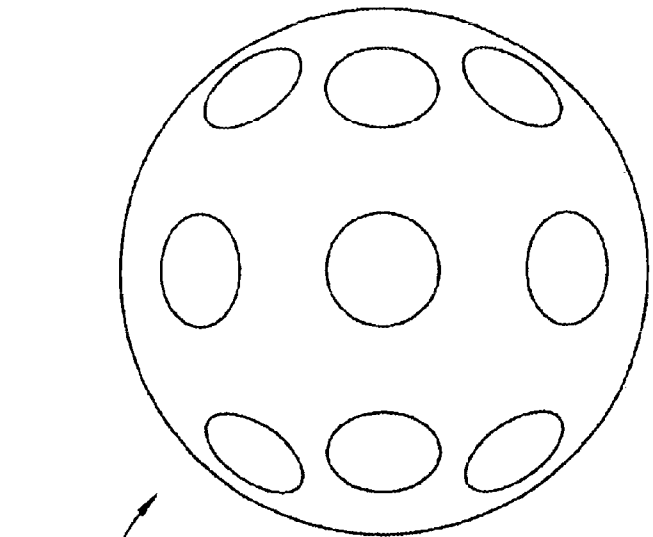
FIG. 13 shows a side view of a spherical connector also constructed in accordance with the invention.
Figure 14:
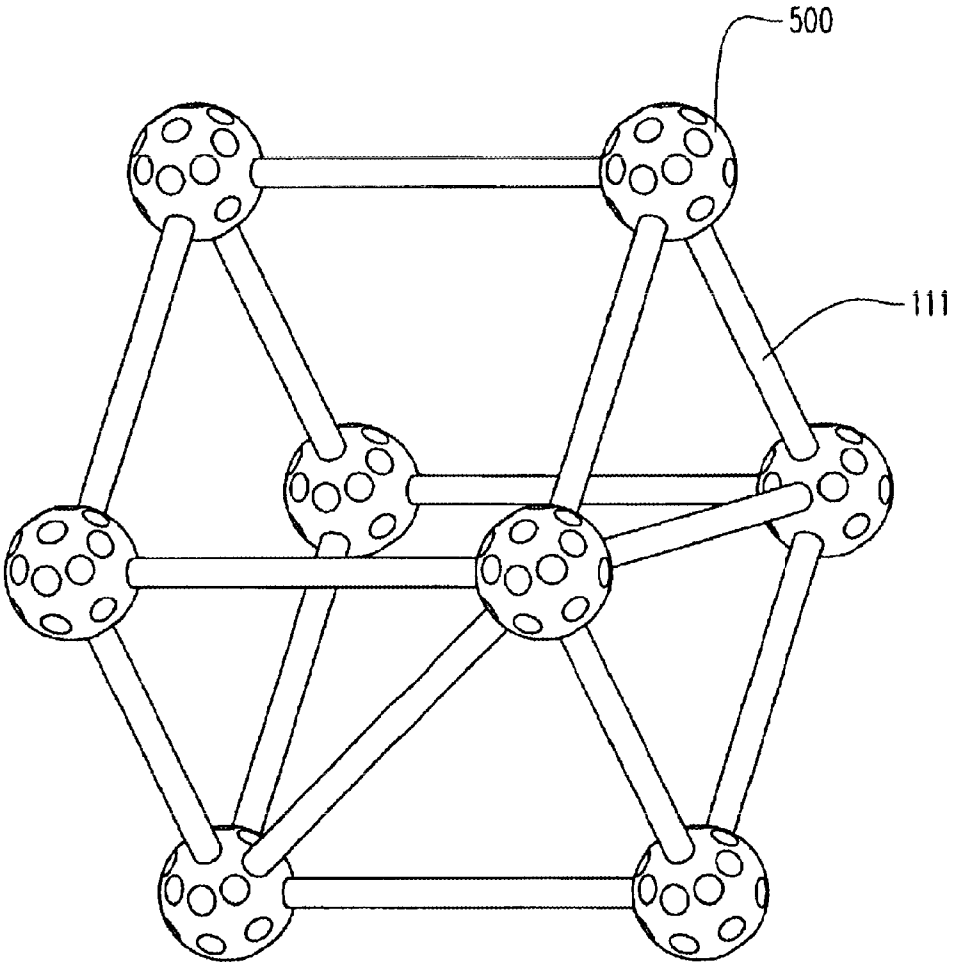
FIG. 14 shows a cube structure made using the spherical connectors of FIG. 13 and with diagonals for extra rigidity.
Figure 16:
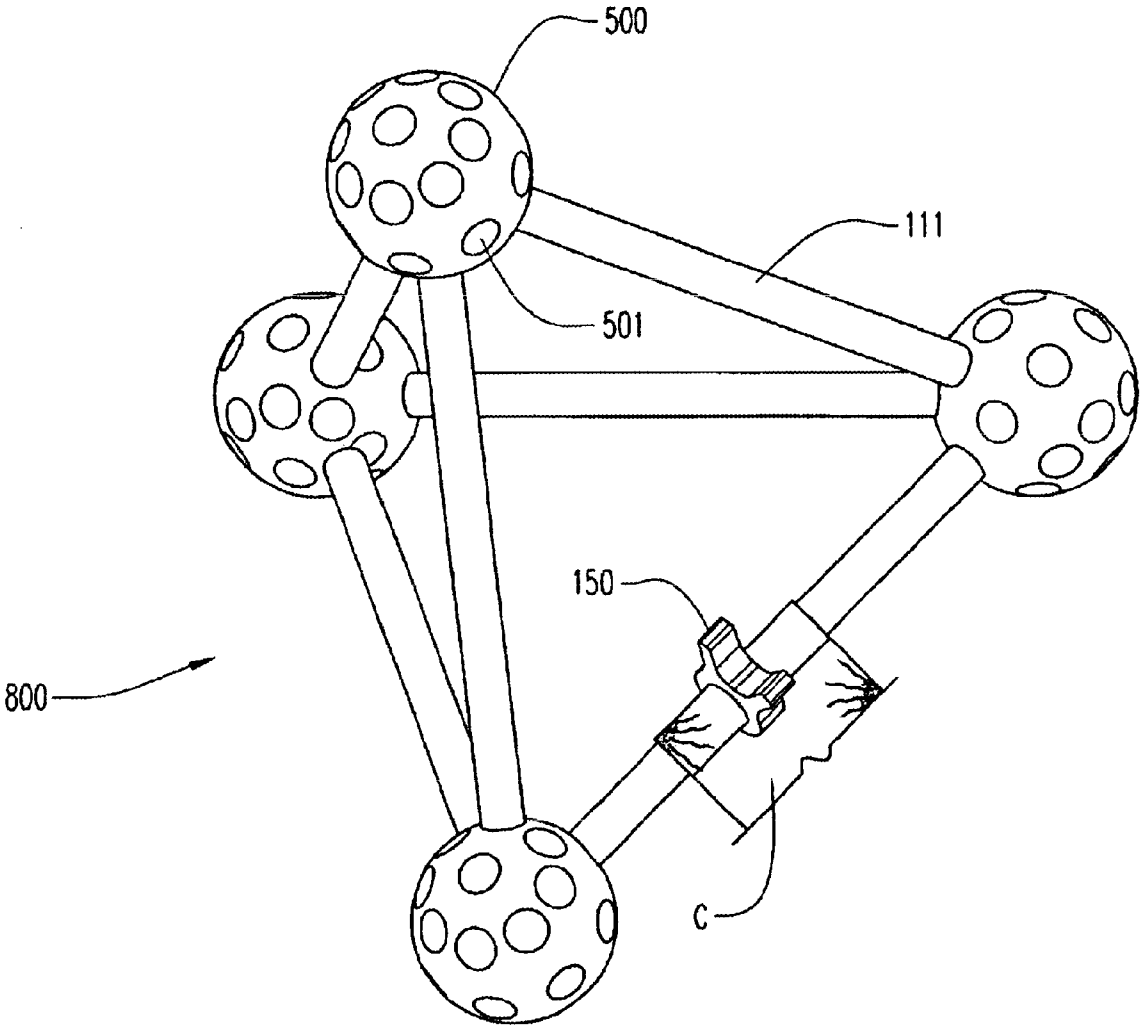
FIG. 16 shows a tetrahedral structure created from spherical connectors of the invention, wherein the connecting rods or tubes have to be slightly bent to fit into the sockets in the connector because the angles are not precisely accurate for a tetrahedron.

As in the case of the polyhedral connector cores of FIGS. 5 and 6, the spherical connector node cores 500, FIGS. 11, 12 and 13, may also be provided with the plurality of adjacent female opening attachment elements 501 (including containing mortises as before discussed) for receiving rods or tubes for attachment and assembling into two and three-dimensional structures. FIG. 16 is an illustration of one such assembly forming a tetrahedral structure 800 with four spherical hollowed connector core nodes 506 and rods or tubes 111, 111*b*, 111*c*, etc. interconnected by attachment at the node connectors at different predetermined angular openings thereof selected as desired to form the four triangular sides of the structure. And FIG. 14 is a three-dimensional diagonally braced cubical structure created from eight node connectors 500 and fourteen rods or tubes 111.

As earlier mentioned, the structural assembly diversity of the invention enables structures to be created in which, for example, children may safely play—and as such, covers or drapes of cloth or other covering material may be attached, as for forming tents or other simulated closures, and for decoration, as well.

Figure 15:
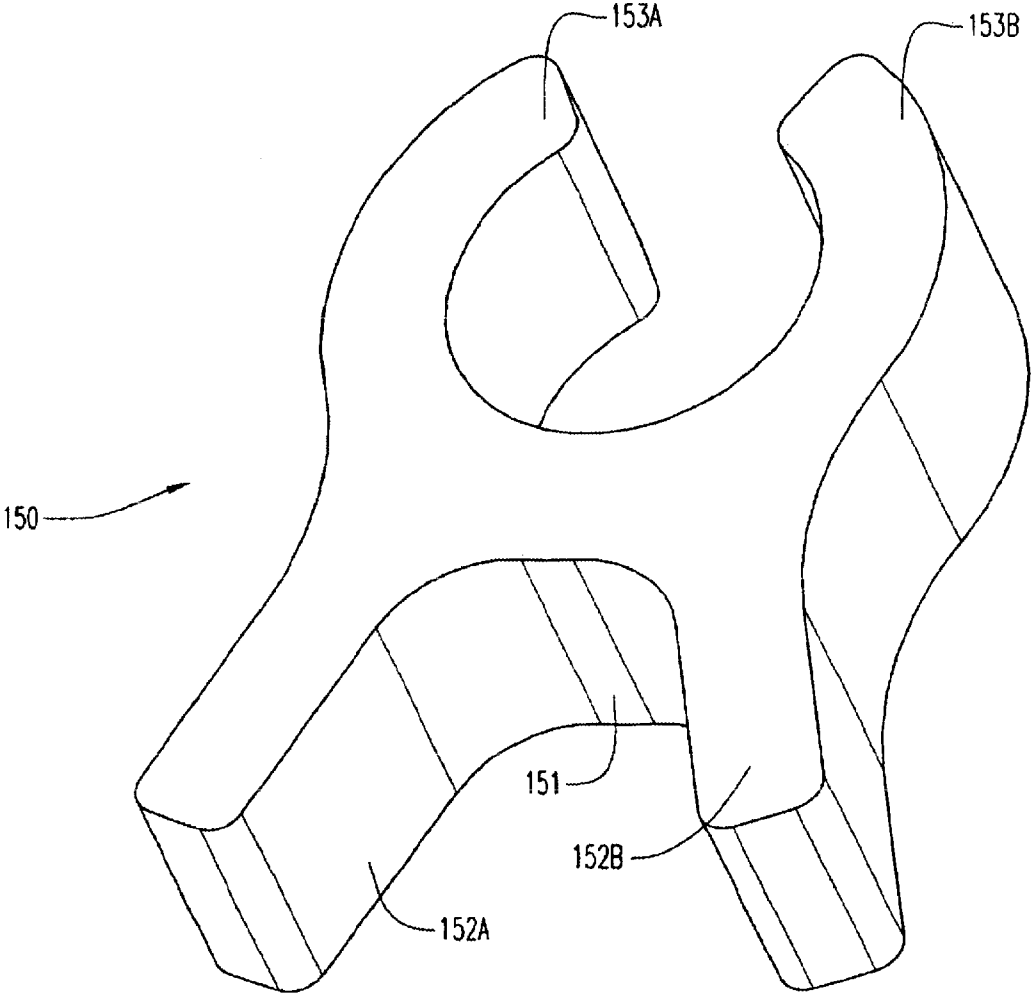
FIG. 15 shows a monolithic clamp for clamping cloth coverings over the structures of the invention.

FIG. 15 shows a preferred type of resilient spring clamp 150 that can be used to clamp such a cloth covering to a connecting tube or rod 111 in any of the structures shown earlier. This readily enables children to create such tent structures. The clamp 150 is a monolithic device wherein the neck region 151 acts as a flexure. When the diverging handles 152A and 152B are resiliently squeezed together, the tips 153A and 153B of the clamp spread apart so the clamp can fit over a tube carrying the cloth covering, a fragment of which is shown at C in FIG. 16. The release of the handle causes the clamp to spring shut over the cloth, covering the tube. Other clamping or attaching devices may also be used.

While, moreover, the novel connector nodes and flexible assembly features of the invention have been described for the important used with foam-like and flexible components by children and others, the novel connector node geometric and assembly designs and features are also useful in conventional construction applications with other conventional types of materials, used for other structural assembly usages as well. Further modifications will also occur to those skilled in this art, and such are considered to fall within the spirit and scope of the invention as defined in the appended claims.

What is claimed is:

1. A flexible-construction set comprising a plurality of tubes or rods inter-connectable by connector nodes and wherein the connector nodes are made of foam-like material and formed in a three-dimensional geometric shape such as to provide a surface contour of successive adjacent surface portions each containing an attachment element therein to provide a plurality of adjacent connection attachment elements spherically distributed over the connector node surface contour for receiving the tubes or rods to be attached thereto and to extend radially therefrom at predetermined desired angles of a corresponding plurality of angles radially diverging from the connector node, wherein the tubes or rods are made of resilent flexible material, and wherein the resilent flexible material is a closed-cell foam material wherein the attachment elements are exteriorly fluted.

2. A flexible-construction set as claimed in claim 1 assembled into a two or three-dimensional structure of interconnected tubes or rods and connector elements.

3. A flexible-construction set as claimed in claim 1 wherein the attachment elements are male prongs.

4. A flexible-construction set as claimed in claim 1 wherein the attachment elements are female openings.

5. A flexible-construction set as claimed in claim 1 wherein said geometric shape is one of substantially spherical shape and hexaoctahedral shape.

6. A flexible-construction set as claimed in claim 1 wherein the geometric shape is of substantially spherical contour, carrying male prong attachment elements substantially symmetrically distributed over the spherical contour at radially diverging angles.

7. A flexible-construction set as claimed in claim 6 wherein the male prong attachment elements comprise fourteen prong elements with the adjacent prong elements radially diverging at 45° from the connector node.

8. A flexible-construction set as claimed in claim 1 wherein the geometric shape is of substantially spherical contour, carrying opening attachment elements substantially symmetrically distributed over the spherical contour along radial direction diverging angles.

9. A flexible-construction set as claimed in claim 8 wherein the opening attachment elements comprise fourteen openings, with adjacent openings distributed along radial directions diverging at 45°.

10. A flexible-construction set as claimed in claim 1 wherein the geometric shape is of substantially polyhedral contour, carrying male prong attachment elements substantially symmetrically distributed over the contour at radially diverging angles.

11. A flexible-construction set as claimed in claim 10 wherein the polyhedral contour is of hexaoctahedral contour containing fourteen prong attachment elements with adjacent prong elements radially diverging at 45° from the connector node.

12. A flexible-construction set as claimed in claim 1 wherein the geometric shape is of substantially polyhedral contour, carrying female opening attachment elements substantially symmetrically distributed over the contour along radial direction diverging angles.

13. A flexible-construction set as claimed in claim 12 wherein the polyhedral contour is of hexaoctahedral contour containing fourteen openings, with adjacent openings distributed along radial directions diverging at 45°.

14. A flexible-construction set comprising a plurality of tubes or rods inter-connectable by connector nodes and wherein the connector nodes are made of foam-like material and formed in a three-dimensional geometric shape such as to provide a surface contour of successive adjacent surface portions each containing an attachment element therein to provide a plurality of adjacent connection attachment elements spherically distributed over the connector node surface contour for receiving the tubes or rods to be attached thereto and to extend radially therefrom at predetermined desired angles of a corresponding plurality of angles radially diverging from the connector node, wherein the attachment elements are male prongs and wherein the prongs are exteriorly fluted.

15. An assembled flexible-construction set comprising a plurality of tubes or rods inter-connectable by connector nodes and wherein the connector nodes are made of foam-like material and formed in a three-dimensional geometric shape such as to provide a surface contour of successive adjacent surface portions each containing an attachment element therein to provide a plurality of adjacent connection attachment elements spherically distributed over the connector node surface contour for receiving the tubes or rods to be attached thereto and to extend radially therefrom at predetermined desired angles of a corresponding plurality of angles radially diverging from the connector node, wherein the set is assembled into a two or three-dimensional structure of interconnected tubes or rods and connector elements, and wherein resilient clamp means is provided along one or more of the tubes or rods to attach covering material over the structure.

* * * * *